US007013697B2

(12) United States Patent
Barber

(10) Patent No.: US 7,013,697 B2
(45) Date of Patent: Mar. 21, 2006

(54) METHOD FOR EXPANDING A TUBULAR BLANK

(75) Inventor: Mark W. Barber, St. Thomas (CA)

(73) Assignee: Magna Structural Systems, Inc., Aurora (CA)

( * ) Notice: Subject to any disclaimer, the term of this patent is extended or adjusted under 35 U.S.C. 154(b) by 50 days.

(21) Appl. No.: 10/482,857

(22) PCT Filed: Jul. 4, 2002

(86) PCT No.: PCT/CA02/01006

§ 371 (c)(1),
(2), (4) Date: Jun. 30, 2004

(87) PCT Pub. No.: WO03/004190

PCT Pub. Date: Jan. 16, 2003

(65) Prior Publication Data

US 2004/0231395 A1 Nov. 25, 2004

Related U.S. Application Data

(60) Provisional application No. 60/302,652, filed on Jul. 5, 2001.

(51) Int. Cl.
*B21D 39/08* (2006.01)

(52) U.S. Cl. ..... 72/370.06; 72/370.22; 72/370.1; 72/318; 72/306; 72/61; 72/62; 72/59; 72/58

(58) Field of Classification Search ..... 72/370.06, 72/370.22, 370.1, 318, 306, 61, 62, 59, 58
See application file for complete search history.

(56) References Cited

U.S. PATENT DOCUMENTS

| | | | | |
|---|---|---|---|---|
| 1,980,264 | A * | 11/1934 | Giesler | 72/59 |
| 3,247,581 | A * | 4/1966 | Pellizzari | 29/890.149 |
| 3,852,987 | A * | 12/1974 | Price et al. | 72/193 |
| 4,297,867 | A * | 11/1981 | Masaki et al. | 72/347 |
| 5,484,892 | A * | 1/1996 | Tedder et al. | 530/388.73 |
| 5,960,660 | A * | 10/1999 | Klaas et al. | 72/61 |
| 6,029,487 | A * | 2/2000 | Genin et al. | 72/58 |
| 6,260,401 | B1 * | 7/2001 | Tada | 72/370.06 |
| 6,826,943 | B1 * | 12/2004 | Rempe et al. | 72/370.06 |

FOREIGN PATENT DOCUMENTS

| | | |
|---|---|---|
| EP | 0 372 360 | 6/1990 |
| EP | 0 982 087 | 3/2000 |
| EP | 1 184 101 | 3/2002 |

* cited by examiner

*Primary Examiner*—Derris H. Banks
*Assistant Examiner*—Teresa M. Bonk
(74) *Attorney, Agent, or Firm*—Clark Hill PLC

(57) ABSTRACT

A method for expanding tubular blanks includes pre-expanding or initially expanding a section of the tube by forcing a punch into an open end of the tube. The punching process may be repeated to achieve up to approximately 50% expansion from the original configuration of the blank. Then, the same pre-expanded section can be further expanded by hydroforming such that the blank is filled with pressurized fluid to achieve further expansion of the initially expanded section up to approximately 100% expansion from the original configuration of the blank. As a final step, the open end of the expanded tube may be cut to its ultimate shape.

15 Claims, 12 Drawing Sheets

METHOD FOR EXPANDING A TUBULAR BLANK

This application claims the benefit of Provisional App. No. 60/302,652, filed Jul. 5, 2001.

FIELD OF THE INVENTION

The present invention relates generally to a method of forming structural members. More specifically, the present invention relates to expanding blanks by a process that includes hydroforming.

BACKGROUND OF THE INVENTION

It is known to mechanically shape metal, tubular blanks by forcing a punch into the blank to expand the end of the blank. However, this process results in only a limited expansion of the blank and only affects the end of the blank. It is also known to shape metal blanks by utilizing fluid forces, such as with known "hydroforming" techniques. Typical hydroforming techniques can result in up to about 30% expansion of the blank from its original configuration. However, the currently available techniques for expanding tubular blanks are not adequate for the growing popularity of hydroforming and the necessity of larger expansion for tubular blanks, beyond that which is achievable with current expansion methods. The present invention addresses this need in the art as well as other needs, which will become apparent to those skilled in the art once given this disclosure.

SUMMARY OF THE INVENTION

One object of the present invention is to provide an improved method for expanding tubular blanks.

Another object of the present invention is to provide a method of expanding tubular blanks utilizing both punching and hydroforming.

Still another object of the present invention is to provide an improved method for expanding a section of a tubular blank from its original configuration beyond those expansion limits previously attainable.

The foregoing objects are basically attained by providing a method for expanding a tubular blank, comprising providing a hollow, tubular blank having a first open end with a central axis and a first section having an inner surface with a closed cross-section extending around the central axis in an original configuration; initially expanding the first section of the tubular blank by inserting a first punch into the first open end of the tubular blank such that the inner surface expands and moves outwardly, further away from the central axis than in the original configuration to form an initially expanded configuration; and further expanding the first section of the tubular blank by hydroforming including placing the tubular blank with the initially expanded configuration into a die cavity having die surfaces, providing a high pressure fluid into an interior of the blank such that the inner surface of the first section further expands and moves further outwardly into conformity with the die surfaces to form a further expanded configuration that is further away from the central axis than in the initially expanded configuration.

These and other objects, features, and advantages of this invention will become apparent from the following detailed description when taken in conjunction with the accompanying drawings, which are a part of this disclosure and which illustrate, by way of example, the principles of this invention.

BRIEF DESCRIPTION OF THE DRAWINGS

The accompanying drawings facilitate an understanding of the various embodiments of this invention. In such drawings.

DETAILED DESCRIPTION OF EXEMPLARY EMBODIMENTS

FIGS. 1–12 illustrate one embodiment of the present invention. The illustrated embodiment provides a method for expanding a tubular blank into a reconfigured part, such as the example reconfigured part illustrated in FIGS. 1–4 and indicated at 10. The tubular blank, or tube, is expanded and shaped into the part 10 that has a desired configuration different from the configuration of the tube and includes a desired cross-section at one or both ends thereof. The reconfigured or desired part 10 is expanded and shaped by the illustrated method which utilizes both mechanical and fluid forming forces, as will be further discussed below.

Figure 1:
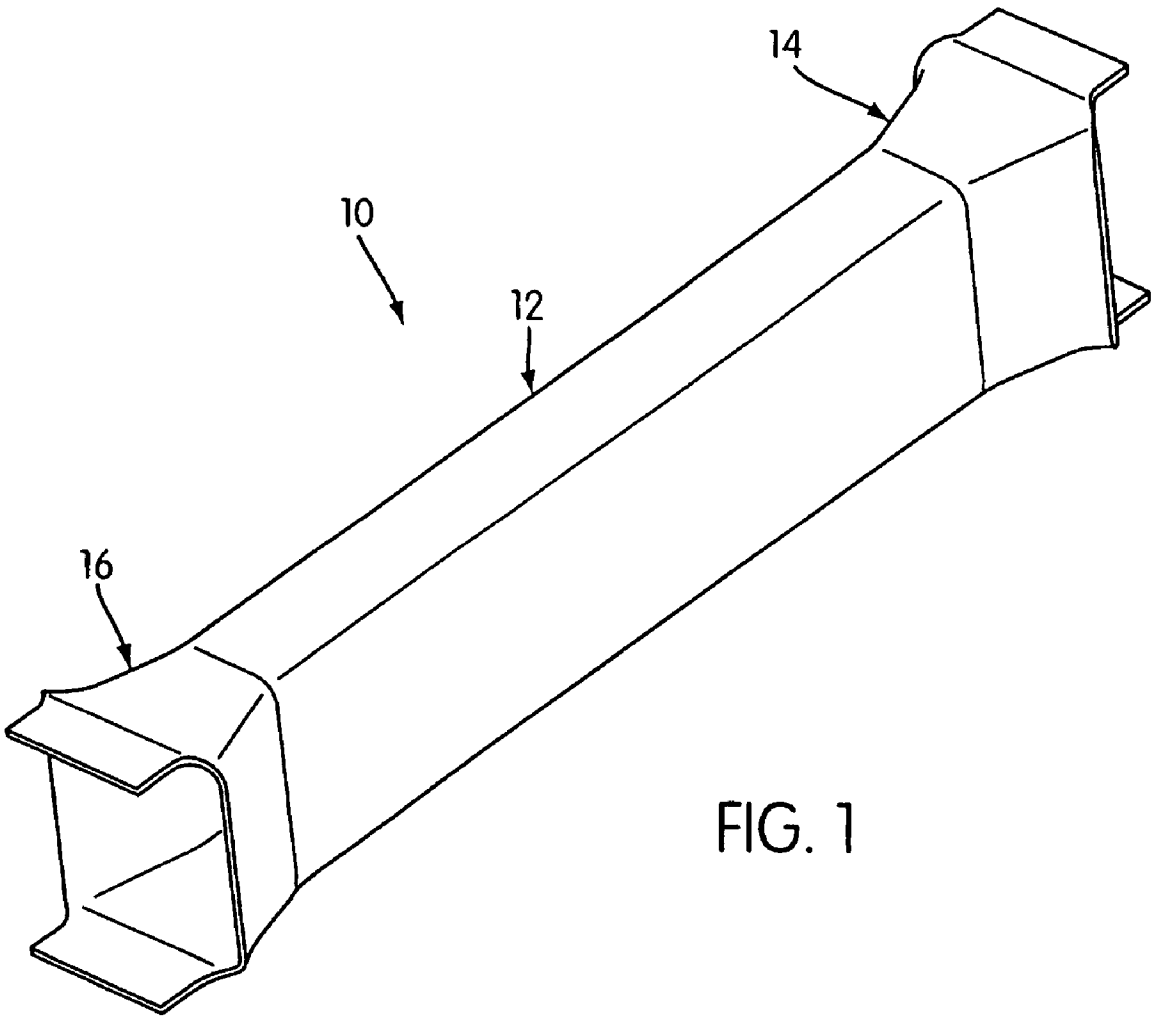
FIG. 1 is a perspective view of an example of a structural part expanded by the illustrated embodiment of the present invention.

The reconfigured part 10 illustrated in FIG. 1 is one example of the application of the illustrated embodiment of the invention. Part 10 has a body portion 12 that is generally rectangular in cross-section with outwardly displaced opposite open ends 14, 16 being similar in configuration. Because the open ends 14, 16 are similar to one another, an understanding of the configuration of one will suffice for an understanding of both.

Figure 2:
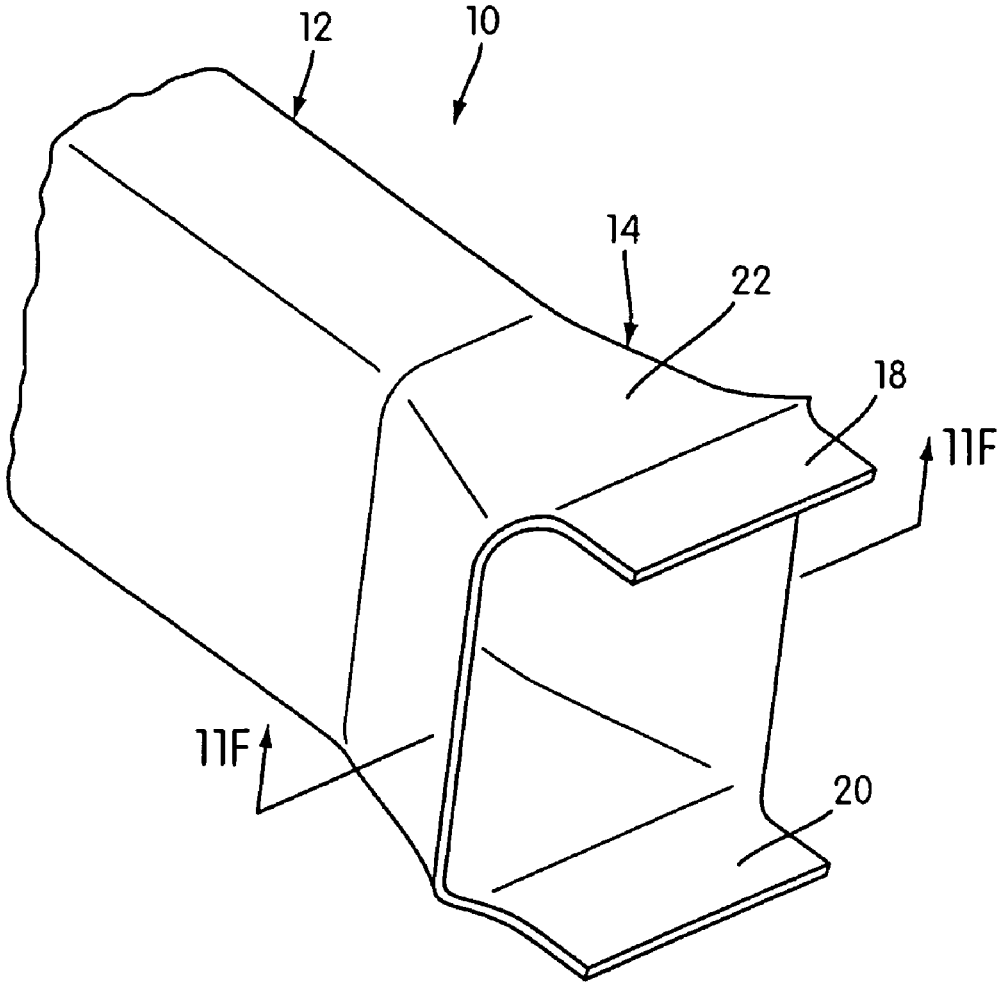
FIG. 2 is an enlarged perspective view of an end of the part of FIG. 1.
Figure 3:
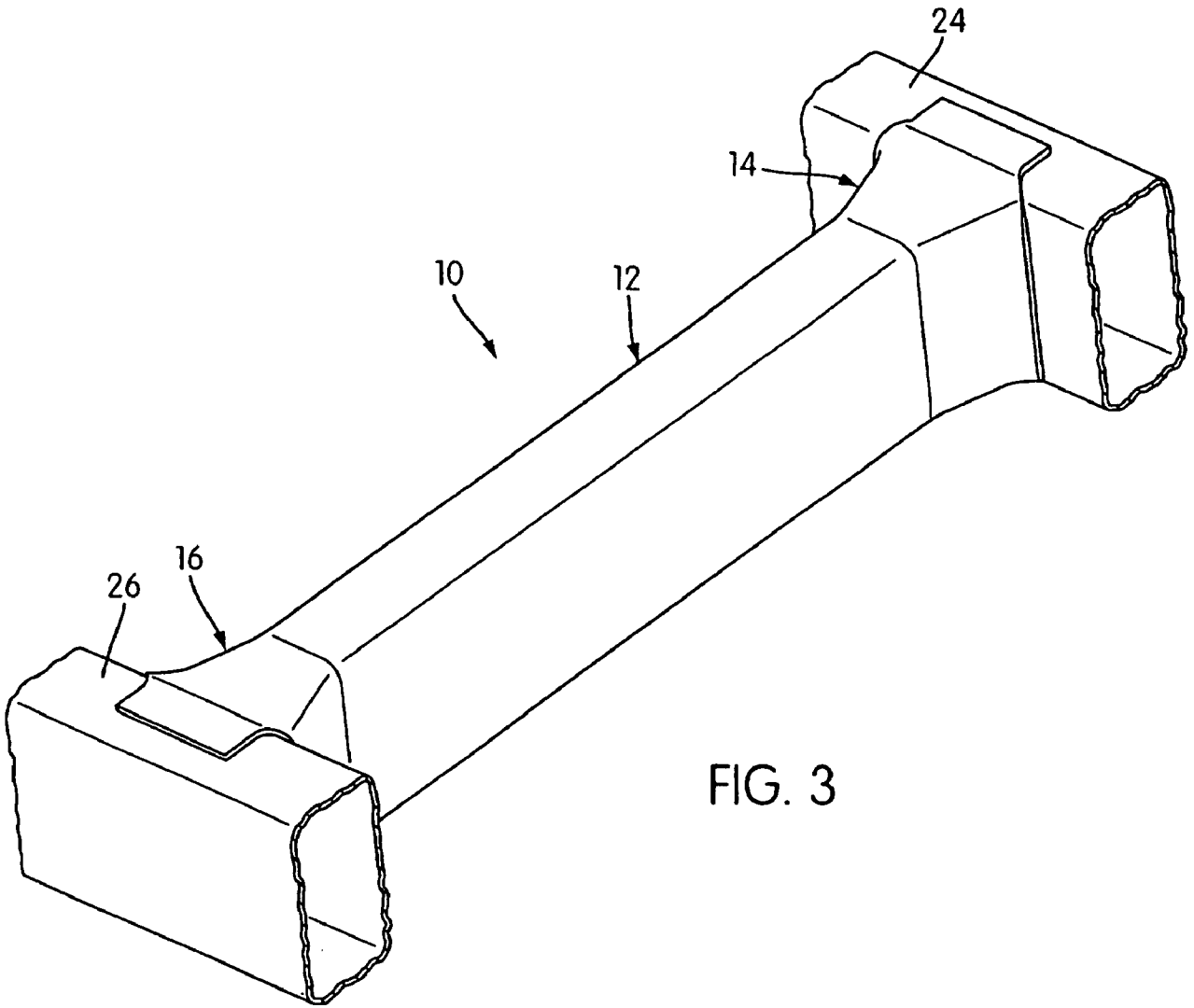
FIG. 3 is a perspective view of the part of FIG. 1 joined at each end with other structural members.
Figure 4:
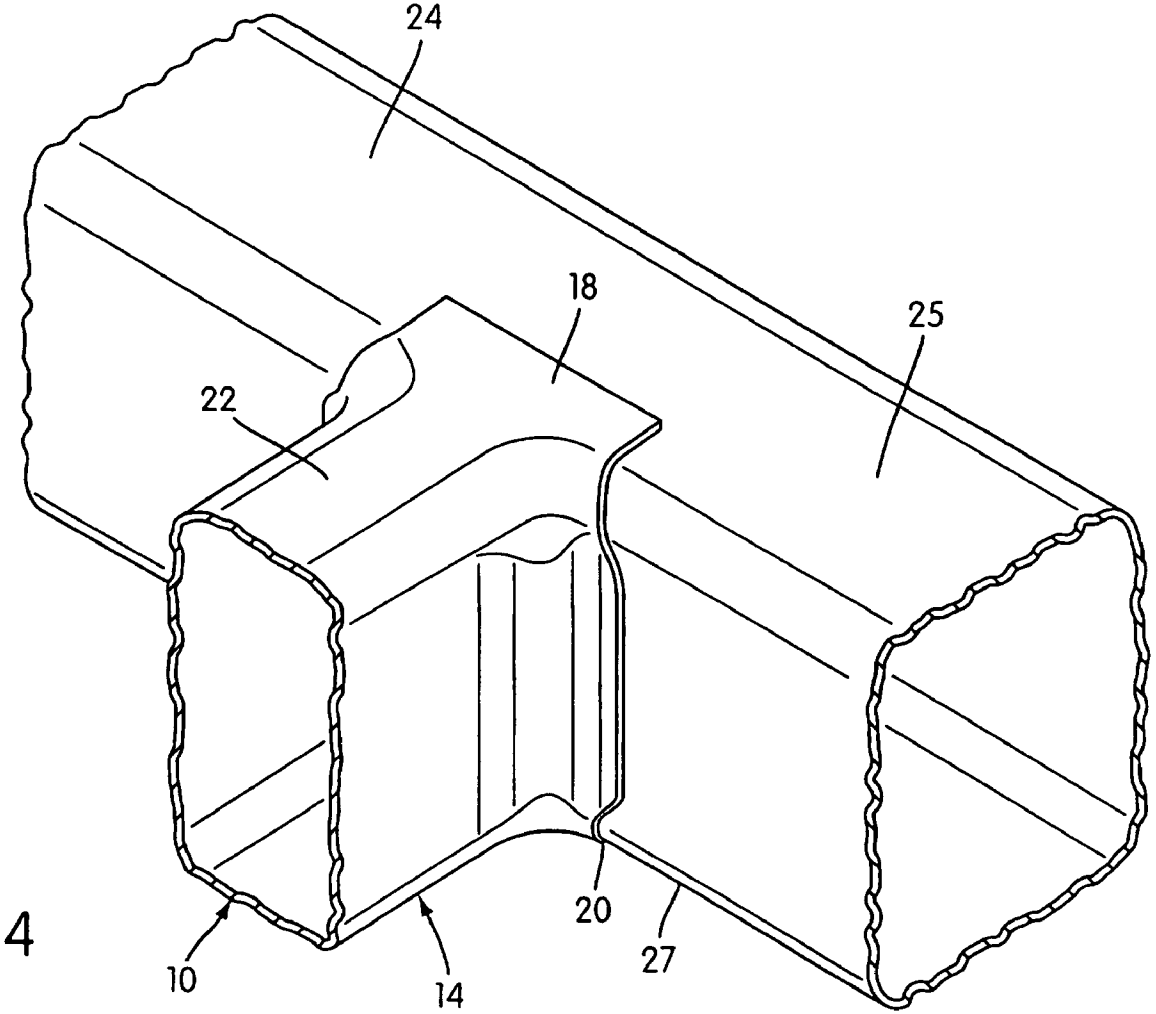
FIG. 4 is an enlarged perspective view of an end of the part of FIG. 3 joined with another blank.

Referring to FIG. 2, the open end 14 has a pair of opposing upper and lower ear portions 18, 20. The ear portions 18, 20 extend from a ramping portion 22, which ramping portion 22 extends from the rectangular body portion 12. The ear portions 18, 20 correspond to a section of the tubular blank which has been expanded up to approximately 100% from the original configuration of the blank of the part 10. As a result, the ear portions of each open end 14, 16 are configured to accommodate other blanks therebetween, for example blanks 24, 26 shown in FIG. 3, such that the ear portions of respective open ends 14, 16 can mate with the other members 24, 26 in surrounding relation when joined thereto. Specifically, FIG. 4 shows the ear portions 18, 20 of open end 14 engaging outer surfaces 25, 27 of opposing ends of the member 24. Although the open ends 14, 16 are configured similarly, it is contemplated that the open ends 14, 16 may have different configurations in order to accommodate members shaped differently than members 24 and 26.

As described in the background, punching and hydroforming are known methods of expanding or shaping a tubular blank. However, the illustrated embodiment of the invention applies these methods to the same section of a tubular blank in order to achieve expansion in amounts that have not been previously achieved by these methods separately. By mechanically punching and applying fluid pressure in sequence to the same section of a tubular blank, up to about 100% expansion of that section may be achieved. The method of expanding a tubular blank into the reconfigured part 10 described above will now be described in greater detail.

Figure 5:
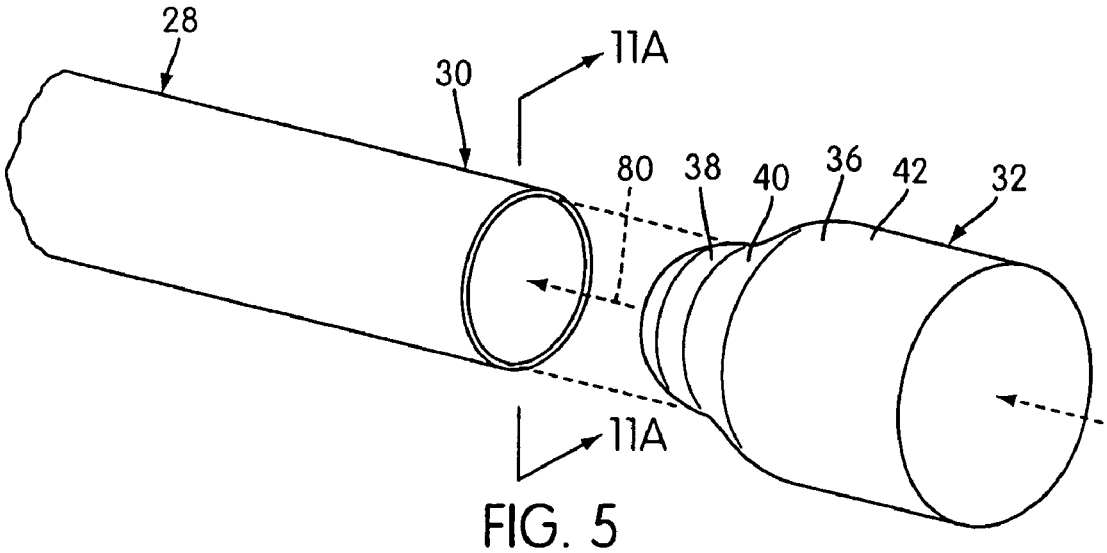
FIG. 5 is a perspective view of a blank and a punch prior to pre-expansion of the tubular blank by a punch in accordance with one embodiment of the present invention.

In FIG. 5, a tubular blank 28, or tube, of predetermined length is provided which has a first open end 30 and a second open end (not shown). The tube 28 may be cut to length or manufactured to the desired length. The first and second open ends are identical to one another, so an understanding of the expansion of the first open end 30 will suffice for an understanding of the expansion of both. It is contemplated that the tube 28 may have only one open end, the other end being closed. Tube 28 can have a longitudinal central axis 80.

Figure 6:
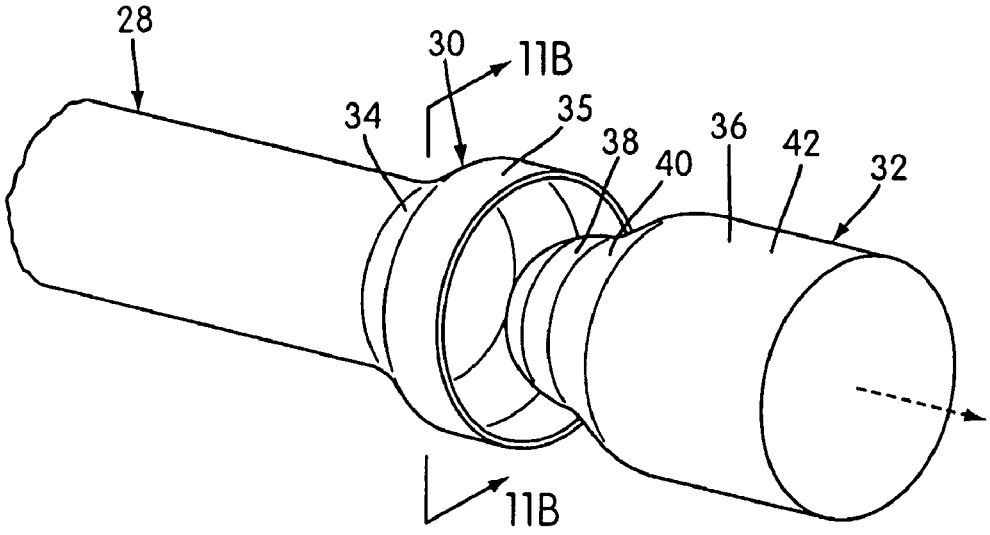
FIG. 6 is a perspective view of the blank of FIG. 5 after initial expansion by the punch.
Figure 7:
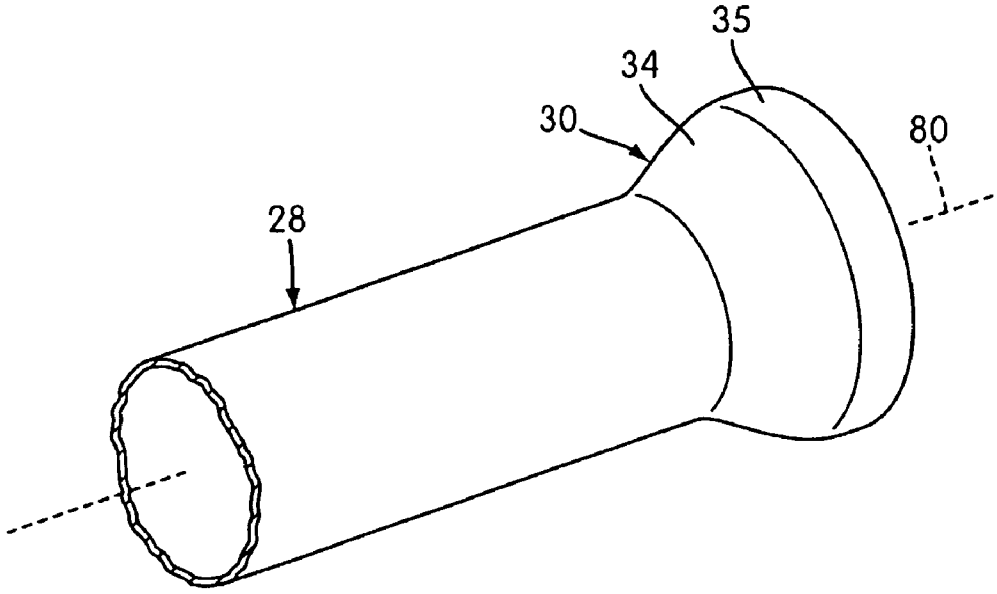
FIG. 7 is an additional perspective view of the initially expanded blank of FIG. 6.
Figure 8:
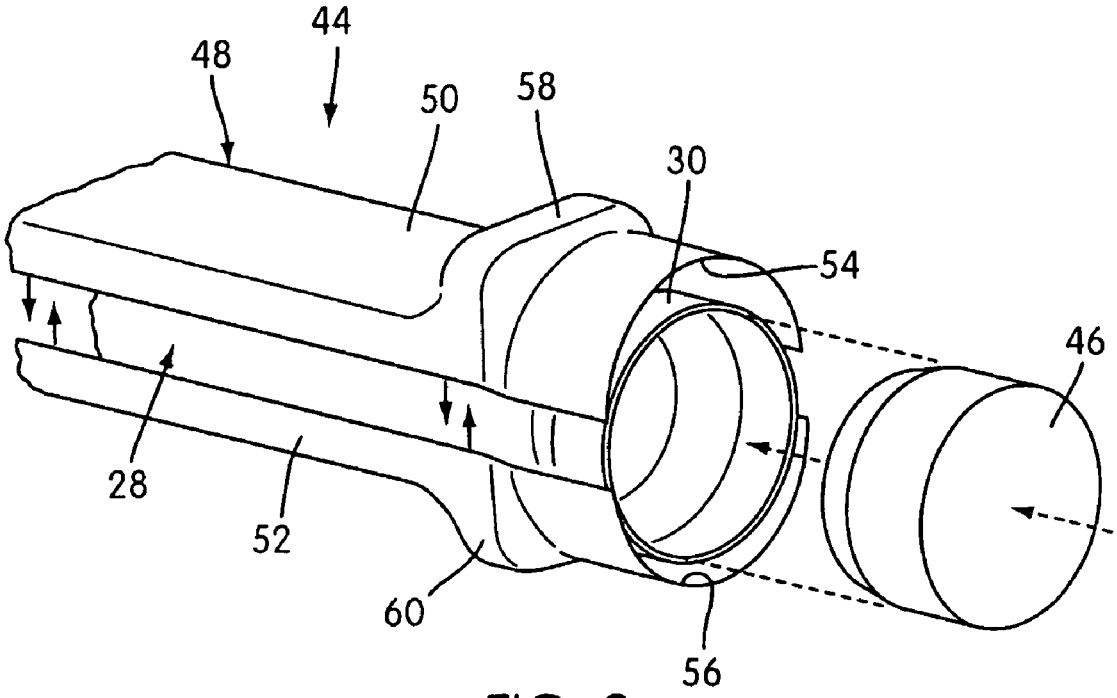
FIG. 8 is a perspective view of the initially expanded blank of FIG. 6 placed within a hydroforming die assembly and prior to further expansion by internal fluid pressure in accordance with one embodiment of the present invention.

First, the tube 28 is positioned within a holding apparatus (not shown) that securely holds the tube 28 and exposes the first open end 30 of the tube 28. A first punch 32, shown in FIGS. 5–6, is moved with sufficient force into forced engagement with the first open end 30 of the tube 28 in order to pre-expand a first section 34 of the first open end 30. A second section 35, which is adjacent the first section 34 and terminates at the first open end 30, is also expanded by the first punch 32.

The first punch 32 can be generally cylindrical or conical in shape and has a larger diameter than the diameter of the tube 28, although other configurations of the first punch 32 are contemplated and can be used depending on the desired configuration of the punched surface, such as section 34. In the exemplary embodiment, the first punch 32 is aligned axially with the tube 28 and forced axially therein such that the first punch 32 expands the tube 28 radially outward. As an example, the punch 32 can expand the tube 28 up to about 50% from its original configuration. An exterior surface 36, or shape, of the first punch 32 corresponds to the desired cross-section at the first open end 30 of the tube 28 after punching. Specifically, the first punch 32 of the exemplary embodiment has a forward portion 38 having a similar diameter than the tube 28, a rear portion 42 having a diameter larger than the tube 28, in this illustrated embodiment, approximately 50% larger than the original configuration of the tube 28, and an intermediate portion 40 that gradually intermeshes the forward and rear portions 38, 42. After the punch 32 is inserted into the tube 28, the first open end 30 is deformed such that the first section 34 conforms to the intermediate portion 40 and the second section 35 conforms to the rear portion 42.

The purpose of punching is to mechanically pre-expand or initially expand the first section 34 of the first open end 30 preferably up to about 50%. The shape of the punch and/or punching procedure may vary according to the desired configuration of the part, but the desired pre-expansion should be attained.

For example, the first punch 32 may be inserted into the first open end 30 a plurality of times to pre-expand the first section 34 along with the second section 35 of the first open end 30 of the tube 28 up to the desired levels, for example, up to about 50% of the original configuration. Specifically, the first and second sections 34, 35 may be pre-expanded in multiple stages, for example two stages, wherein the first punch 32 is inserted and retracted a plurality of times to achieve the desired pre-expansion.

It is contemplated that additional punches may be employed to provide varying degrees of expansion to the end 14. For example, a second punch can be provided, which may be larger in diameter than the first punch 32, and the pre-expanding of the first section 34 along with the second section 35 can include inserting the second punch into the first open end 30 of the tube 28 after inserting the first punch 32 into the first open end 30 of the tube 28. Similar to above, insertion of the first and second punches can pre-expand the first and second sections 34, 35 of the first open end 30 up to the desired amount, for example, up to about 50% of the original configuration. It is also contemplated that multiple punches may be used or that multiple insertions of multiple punches may be use in order to mechanically pre-expand the second section 35 in addition to the first section 34 up to the desired amount of expansion. Additionally, although reference is made to "punching" and to punch 32, it should be understood that "punching" refers to inserting a mechanical device into the tube 28 with a sufficient force to expand the tube outwardly away from the central axis 80 and that the initial expansion can be performed in a variety of ways and that mechanical initial expansion can be performed by punches such as those illustrated and described herein or by other devices that can mechanically expand to the desired levels.

After the desired pre-expansion is achieved, the punch 32 is retracted from the first open end 30 of the tube 28. Then, the pre-expanded tube 28 is positioned within an assembly, which is capable of providing internal fluid pressure to the tube 28. Hydroforming die assemblies performing a known "hydroforming" technique are typically utilized for this procedure. A hydroforming die assembly, generally shown at 44, comprises a pair of tube-end engaging blanks, one of the engaging blanks indicated at 46, and a die structure 48 having movable upper and lower halves 50, 52. The upper and lower halves 50, 52 of the die structure 48 have interior surfaces 54, 56 respectively that cooperate to define a die cavity therebetween with the interior surfaces 54, 56 of the die structure 48 defining the desired shape of the reconfigured part 10.

The pre-expanded tube 28 is placed in the lower halve 52 of the die structure 48 with the upper halve 54 of the die structure 48 being moved to form the die cavity. Then, the tube-end engaging blanks 46 are mechanically inserted into the opposing first open end 30 and second open end to close and seal the same while a valve (not shown) incorporated into the pair of tube-end engaging blanks is opened to communicate a source of fluid, such as hydraulic fluid or water, within the tube 28 interior. Upon filling of the sealed tube 28 with fluid, the fluid is then pressurized within inner surfaces 29 of the tube 28 to form expansion against the interior surfaces 54, 56 defining the die cavity. Although FIG. 8 only shows the first open end 30, it should be understood that the second open end is expanded similarly.

The die structure 48 shapes the tube 28 into the reconfigured rectangular shaped part 10 with the pre-expanded first section 34 of the tube being further expanded up to the desired levels, for example, up to about 80–100% of the original configuration, or to approximately 100% of the original configuration, as illustrated. In other words, the first section 34 has an original outer perimeter and further expanding the first section 34 includes further expanding the original outer perimeter to a final outer perimeter that can be approximately two times larger than the original outer perimeter. Thus, the first section 34 is further expanded up to about 100% greater from its original shape.

Specifically, the tube 28 is expanded into conformity with the interior surfaces 54, 56 of the die structure 48 of the hydroforming die assembly 44. An end of the upper and lower halves 50, 52 of the die structure 48 has an enlarged interior surface configuration 58, 60 respectively corresponding to the desired enlarged cross-section of the first section 34 of the first open end 30.

Figure 9:
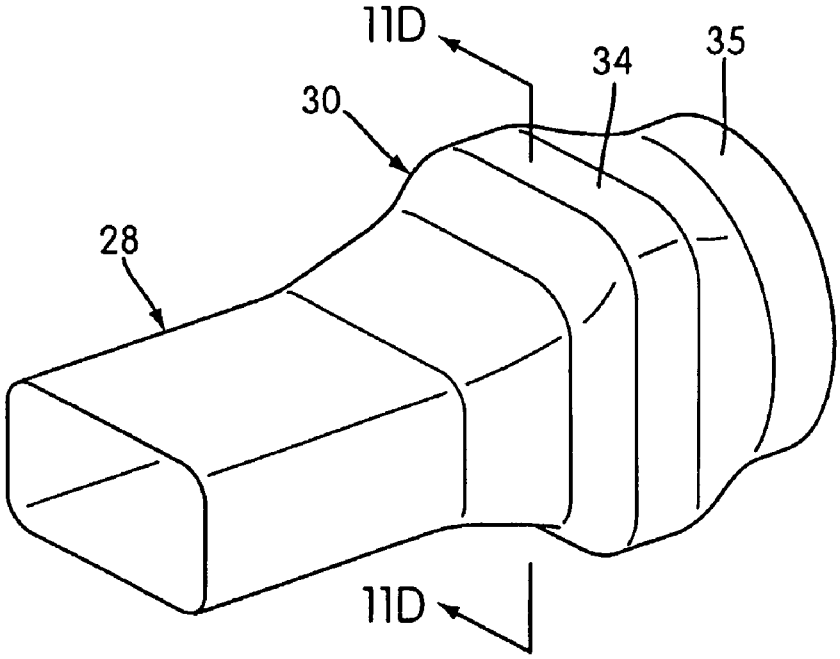
FIG. 9 is a perspective view showing the initially expanded blank of FIG. 7 after further expansion by internal fluid pressure as in FIG. 8.

FIG. 9 shows the tube 28 after further expansion by internal fluid pressure. The first section 34 is expanded up to about 100% with the second section 35 slightly expanding or keeping similar expansion levels. The second section 35 functioned to accommodate the tube-end engaging blank and to facilitate the expansion of the first section 34. The second section 35 may be removed in order to form the reconfigured part 10, as will be further discussed.

Figure 10A:
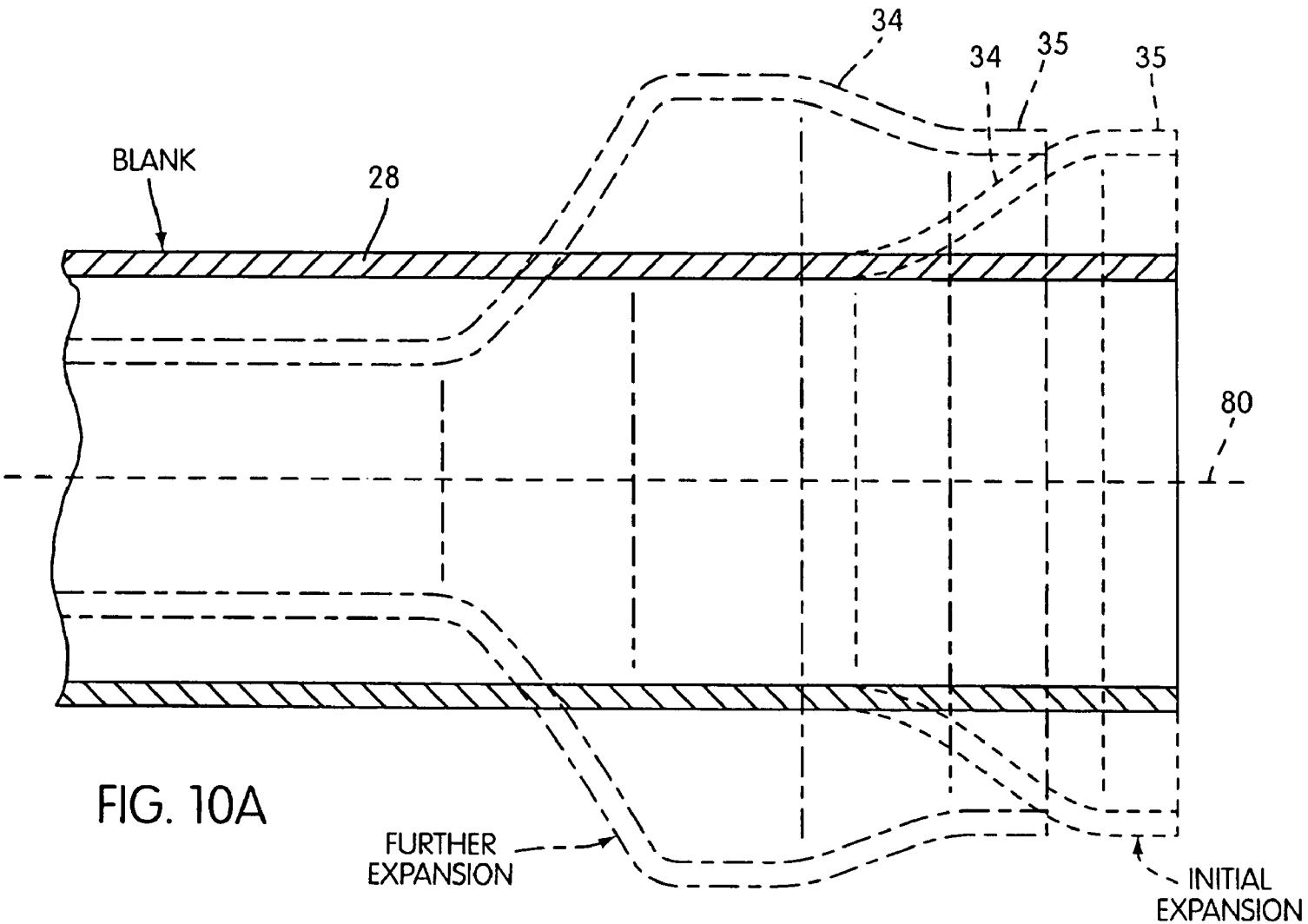
FIG. 10A is a cross-sectional view showing an end of the blank illustrated in FIGS. 1–9 with the blank prior to expansion illustrated in solid lines, with the blank after initial or pre-expansion by a punch illustrated in dashed lines, and with the blank after further expansion by internal fluid pressure or hydroforming illustrated in broken lines.
Figure 10B:
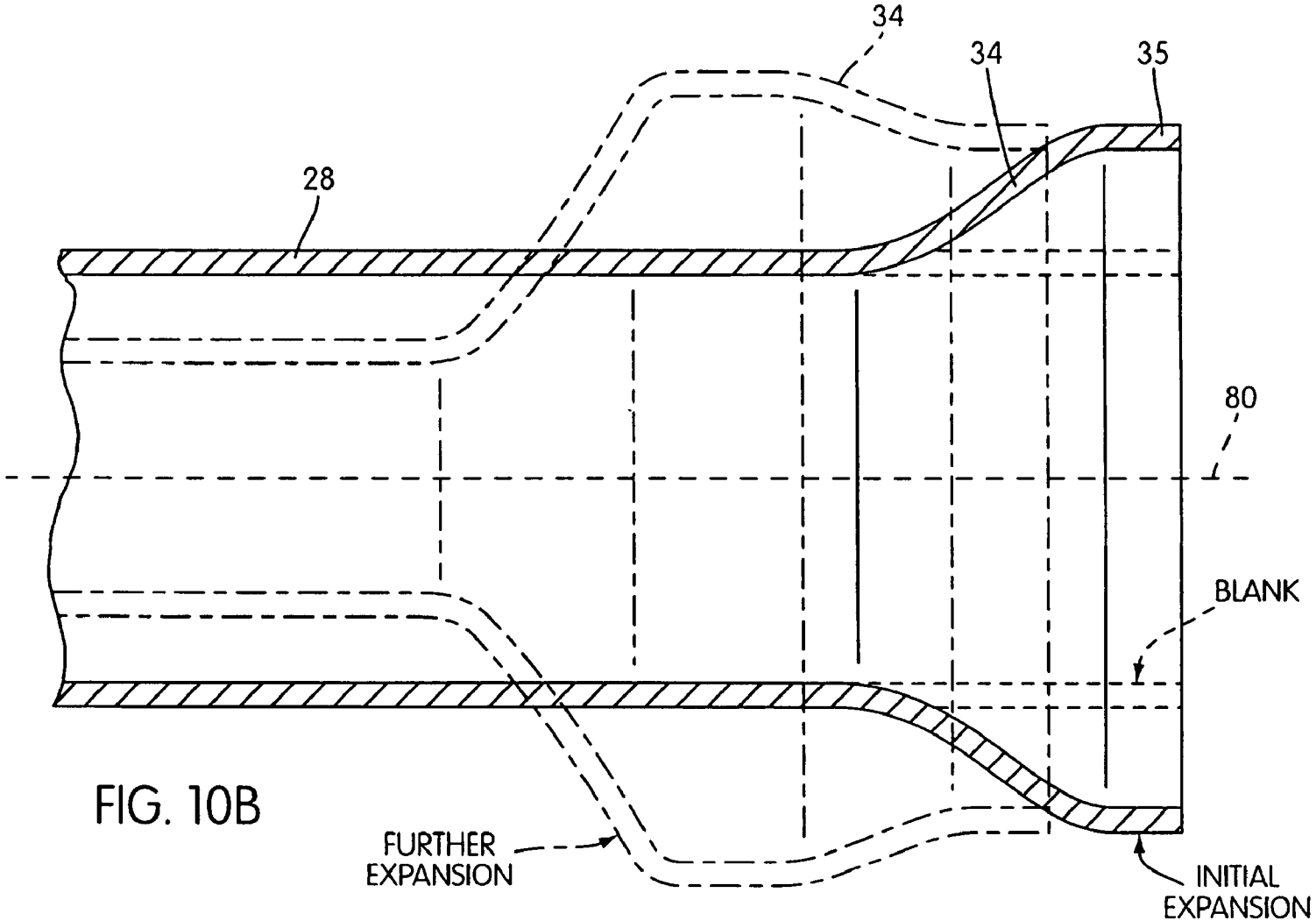
FIG. 10B is a cross-sectional view similar to FIG. 10A, but showing an end of the blank illustrated in FIGS. 1–9 with the blank prior to expansion illustrated in dashed lines, with the blank after initial or pre-expansion by a punch illustrated in solid lines, and with the blank after further expansion by internal fluid pressure or hydroforming illustrated in broken lines.
Figure 10C:
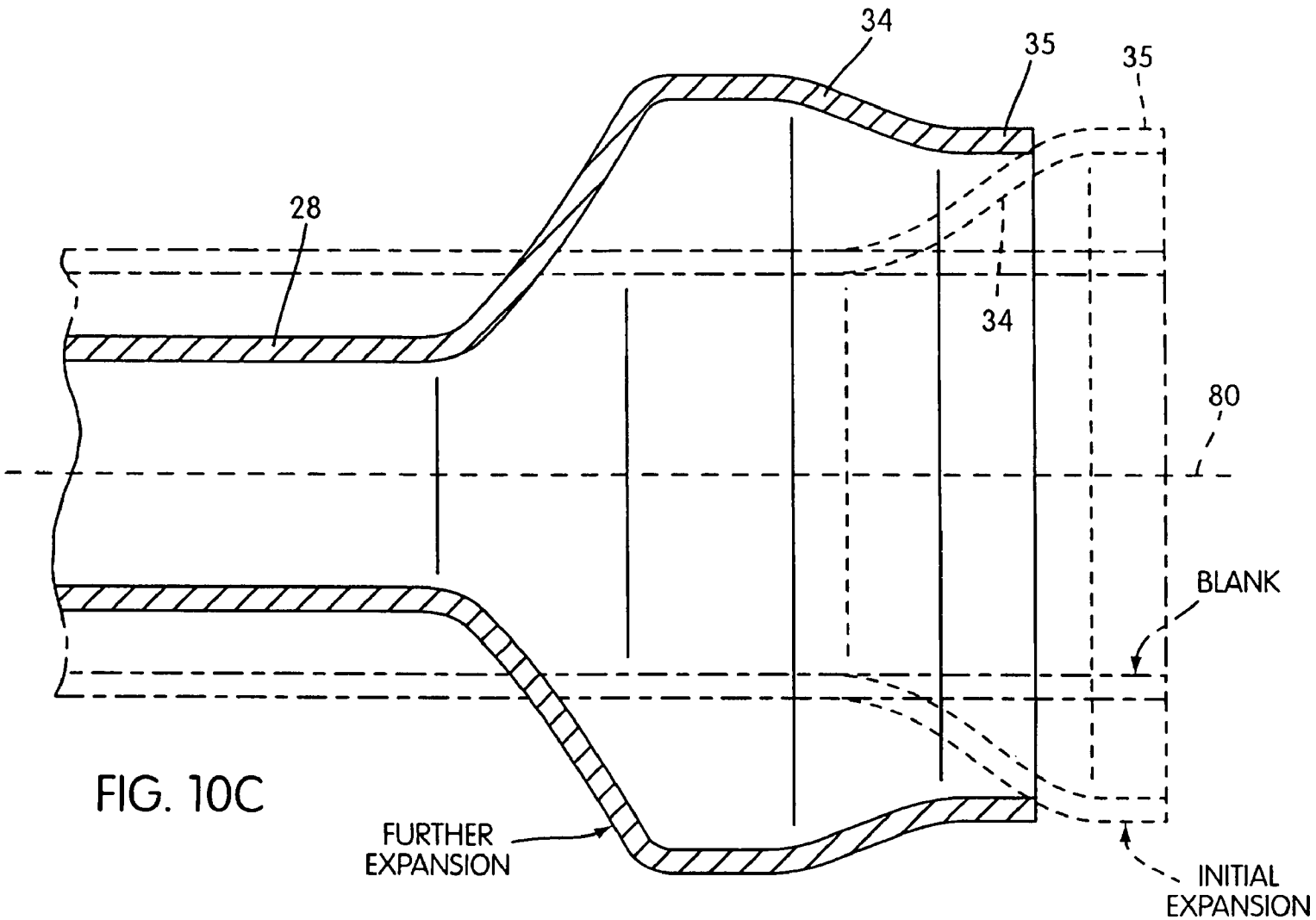
FIG. 10C is a cross-sectional view similar to FIG. 10A, but showing an end of the blank illustrated in FIGS. 1–9 with the blank prior to expansion illustrated in broken lines, with the blank after initial or pre-expansion by a punch illustrated in dashed lines, and with the blank after further expansion by internal fluid pressure or hydroforming illustrated in solid lines.

FIGS. 10A–10C show the expansion of the tube 28 in its original configuration as a blank, after punching, and after hydroforming in relation to one another. Specifically, FIG. 10A shows the tube 28 prior to expansion in solid lines. FIG. 10B shows the tube 28 after the desired pre-expansion by punching is achieved, in solid lines. FIG. 10C shows the tube 28 after further expansion by internal fluid pressure or hydroforming, in solid lines.

Figure 11A:
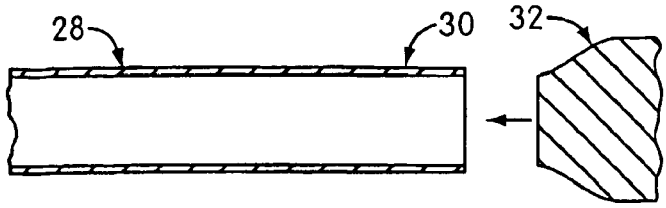
FIGS. 11A through 11F are cross-sectional views of the embodiment of the present invention illustrated in the previous figures with FIG. 11A illustrating the blank prior to initial expansion, FIG. 11B illustrating the blank after initial expansion, FIG. 11C illustrating the further expansion by hydroforming, FIG. 11D illustrating the blank after the further expansion, FIG. 11E illustrating the blank after the initial cutting step, and FIG. 11F illustrating the blank after the final cutting step.
Figure 11B:
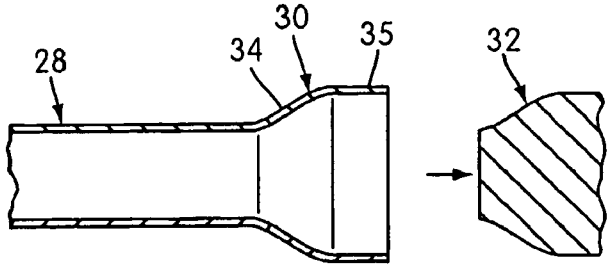
Figure 11C:
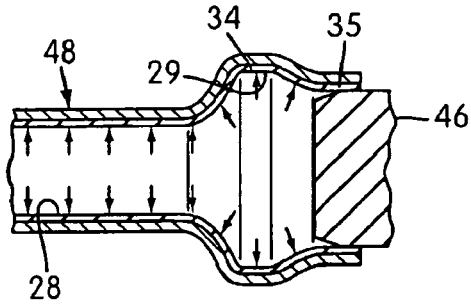
Figure 11D:
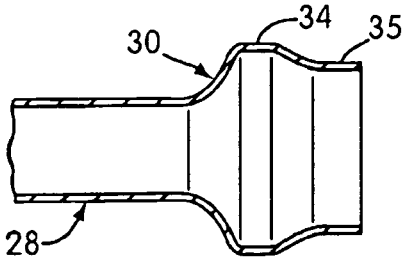

In general, referring to FIGS. 11A–11F, the illustrated method for expanding the blank 28 is illustrated. The illustrated method includes providing a blank tube 28 (FIG. 11A) and pre-expanding the first section 34 of the first open end 30 of the tube 28 by axially inserting and then removing the first punch 32 into the first open end 30 of the tube 28 (FIG. 11B). The tube 28 is then further expanded with the expansion of the first section 34 of the first open end 30 by providing fluid within the tube 28 and applying fluid pressure to inner surface 29 of the first section of the tube 28 (FIG. 11C). A further expanded tube 28 is thus produced (FIG. 11D). Of course, further expansions and manipulation to the tube 28 can occur.

Figure 11E:
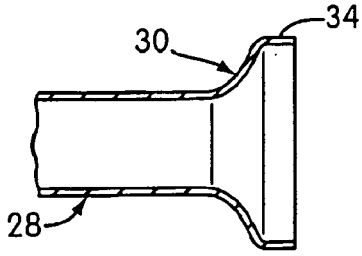
Figure 11F:
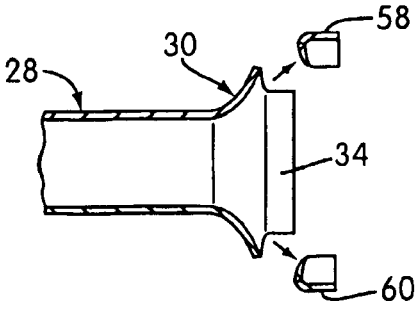

Once expanded to the desired configuration, the tube 28 can be cut to the specific shape required for the application of the tube 28 as a structural member. For example, the first section 34 of the first open end 30 can be cut to the ultimate desired shape or configuration of the part, as for example the reconfigured part 10. Specifically, the second section 35 can be trimmed and cut to length either mechanically or by laser (FIG. 11E). The mechanical cutting may include coping. Then, additional cutting steps can be performed such as having portions such as in FIG. 11F. As illustrated in FIG. 11F, the sides 58, 60 of the first section 34 are cut to finish the desired trim of the reconfigured part 10 (FIG. 11F).

The part 10 of the illustrated embodiment after cutting is shown in FIG. 2. The open end 14 of the part 10 refers to open end 30 of the tube 28. The ear portions 18, 20 correspond to the remaining portions of the first section 34 after cutting. The body portion 12 corresponds to the tube 28 after hydroforming.

Figure 12:
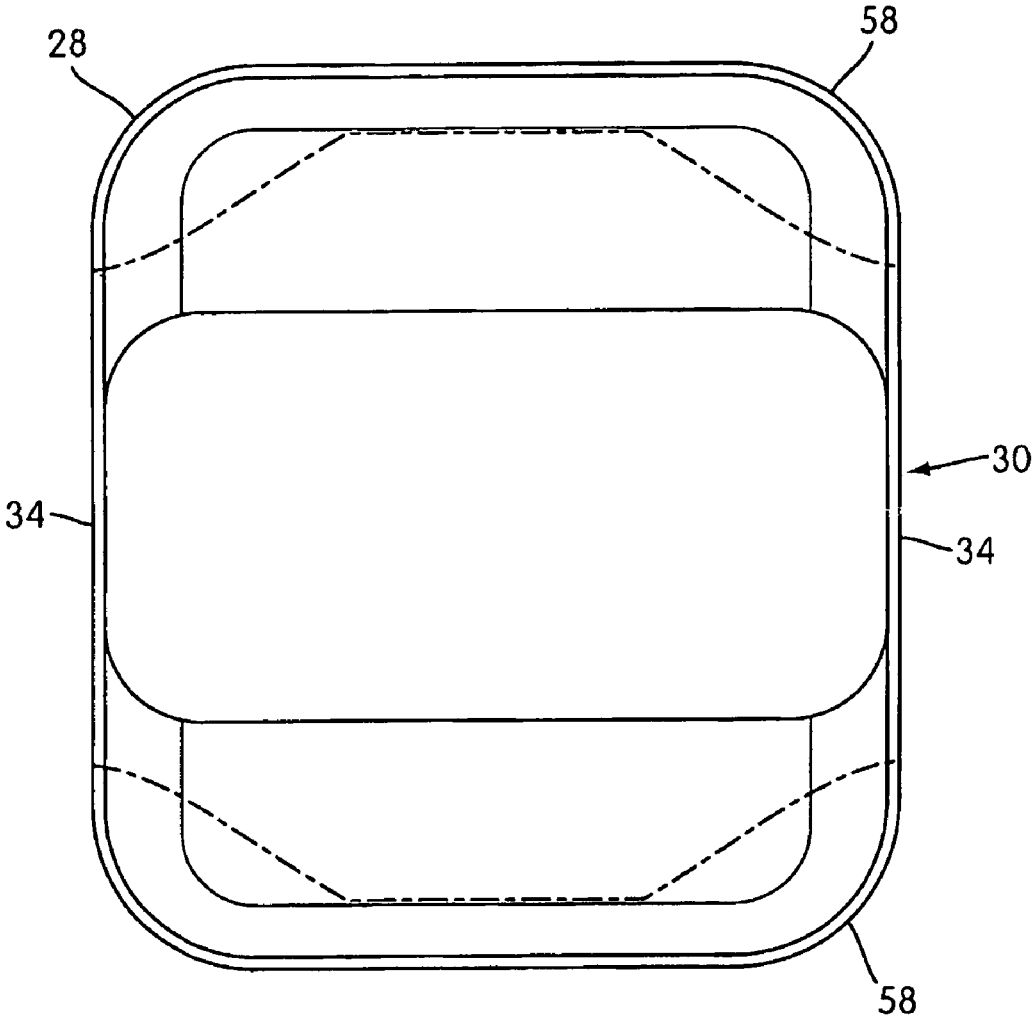
FIG. 12 is a front plan view showing an end of the blank illustrated in FIG. 11D after further expansion but before cutting with dashed lines indicating cutting lines when cutting to the ultimate shape.

FIG. 12 shows the tube after hydroforming with cutting lines shown as dashed lines. It is contemplated that the open end may be cut in multiple ways to obtain different end configurations in order to accommodate different other blanks.

It is contemplated that the tube can be bent prior to expanding the first section. Bending may be done by such methods as mechanically bending or by hydroforming.

Although the reconfigured part has a generally rectangular cross-section, it is contemplated that the part may have other configurations, such as circular or other non-circular cross-sections, for example, square or polygonal.

As noted above, the second open end may be configured in a similar manner as the first open end. The first and second open ends may be initially expanded at the same time and may be further expanded at the same time or the first and second open ends may be initially expanded and further expanded at different times.

Once cut to its ultimate shape, the part 28 can mate with other elements as desired. As illustrated, the part 28 can fully glove the mating part and form an improved joint. This illustrated process can be cost effective relative to other methods of expansion that do not provide the expansion levels as discussed with respect to the illustrated embodiment.

There are other methods contemplated than the one described above wherein the open ends are expanded by a punch and further expanded by hydroforming. One alternative is to expand both ends by a punch as disclosed in commonly assigned U.S. Provisional Patent Application No. 60/241,337 filed on Oct. 19, 2000, for Apparatus and Method for Hydroforming a Tubular Part, which is hereby incorporated herein by reference in its entirety. The punch in the '337 application has an outer-cross-section configuration corresponding to the desired cross-section of the finally-configured part. Thus, no material has to be removed to finish the part. The ends may then further expanded by the hydroforming as disclosed in the illustrated embodiment. Another alternative is to expand one end using the method disclosed in the '337 application and expand the other end using the method of the illustrated embodiment. In the '377 application, the punch is also used to seal the end during hydroforming. Still another contemplated alternative is to expand the tube according to the illustrated embodiment and then further expand the second section of the tube by utilizing the punch of the '377 application so as to not have to remove the second section.

In designing vehicle suspension cradles, for example, joint strength plays a major role in determining tube size and gauge. If the open ends are "super expanded" up to about 100% by the method of the illustrated embodiment described above, the open ends provide a large gloving footprint. As a result, better packaging, reduced mass and cost may be realized.

Expansion is governed by limitations in material elongation and die friction. By pre-expanding the tube by a punch before hydroforming, as described above, the transition leading up to the reconfigured part is drastically reduced. Pushing force may be applied directly to the expansion and growing of the first section of the open ends. Very little tube is contact with the die structure in the expansion area, thus resulting in little friction. By keeping the overall reconfigured part relatively square or rectangular, the risk of wrinkling is reduced during pushing and draw strains are ensured. The strains introduced into the part during expansion increases the strength of the part.

Although the use of the super expanded parts 28 are limitless, one contemplated applications for "super expanded" parts for joints in hydroformed motor vehicle frames, such as rear joints in delta engine cradles, front joints in suspension cradles, and cross-blanks.

It can thus be appreciated that the objectives of the present invention have been fully and effectively accomplished. The foregoing specific embodiments have been provided to illustrate the structural and functional principles of the present invention and is not intended to be limiting. To the contrary, the present invention is intended to encompass all modifications, alterations, and substitutions within the spirit and scope of the appended claims.

What is claimed is:

1. A method for expanding a tubular blank, comprising providing a hollow, tubular blank having a first open end with a central axis and a first section having an inner surface with a closed cross-section extending around the central axis in an original configuration;

initially expanding the first section of the tubular blank by inserting a first punch into the first open end of the tubular blank such that the inner surface expands and moves outwardly, further away from the central axis than in the original configuration to form an initially expanded configuration; and further expanding the first section of the tubular blank by hydroforming.

2. A method according to claim 1, wherein the first section is initially expanded approximately 50% greater than the original configuration.

3. A method according to claim 1, wherein the first section is further expanded approximately more than 80% greater than the original configuration.

4. A method according to claim 1, wherein the first section is further expanded approximately 100% greater than the original configuration.

5. A method according to claim 1, wherein initially expanding the first section includes inserting the punch into the first open end of the blank a plurality of times.

6. A method according to claim 1, wherein initially expanding the first section includes inserting a second punch into the first open end of the tubular blank after inserting the first punch into the first open end of the tubular blank.

7. A method according to claim 1, further comprising bending the tubular blank prior to initially expanding the first section.

8. A method according to claim 1, further comprising cutting the first section to an ultimate shape.

9. A method according claim 8, wherein the cutting of the first section is performed by a laser.

10. A method according to claim 8, wherein the first open end has a second section and the cutting of the first section includes cutting the second section to a desired length and cutting sides of the first section to a finished shape.

11. A method according to claim 1, wherein the providing of the hollow, tubular blank includes providing the tubular blank with a second open end with a second section having an inner surface with a closed cross-section extending around the central axis in an original configuration;

initially expanding the second section of the tubular blank buy inserting a second punch in the second open end of the tubular blank such that the inner surface expands and moves outwardly, further away from the central axis than in the original configuration to form an initially expanded configuration; and further expanding the second section of the tubular blank by hydroforming such that the inner surface of the second section further expands and moves further outwardly into conformity with the die surfaces to form a further expanded configuration that is further away from the central axis than in the initially expanded configuration.

12. A method according to claim 11, wherein the first and second open ends are initially expanded at the same time.

13. A method according to claim 12, wherein the first and second open ends are further expanded at the same time.

14. A method according to claim 1, wherein the initially expanding of the blank includes inserting a punch with a predetermined shape to configure a terminal part of the open end into a final shape.

15. A method according to claim 1, wherein said further expanding the first section of the tubular blank by hydroforming, includes placing the tubular blank with the initially expanded configuration into a die cavity having die surfaces, providing a high pressure fluid into an interior of the blank such that the inner surface of the first section further expands and moves further outwardly into conformity with the die surfaces to form a further expanded configuration that is further away from the central axis than in the initially expanded configuration.

* * * * *